United States Patent [19]

Kulle et al.

[11] Patent Number: 4,993,917

[45] Date of Patent: Feb. 19, 1991

[54] GAS COMPRESSOR HAVING DRY GAS SEALS

[75] Inventors: Vaclav Kulle, Blind Bay; Robert A. Peterson, Calgary, both of Canada

[73] Assignee: NOVA Corporation of Alberta, Calgary, Canada

[21] Appl. No.: 410,046

[22] Filed: Sep. 19, 1989

[30] Foreign Application Priority Data

Sep. 30, 1988 [CA] Canada ..... 578979

[51] Int. Cl.[5] ..... F01D 3/00; F01D 11/00

[52] U.S. Cl. ..... 415/105; 415/107; 415/112; 415/118; 415/174.2; 415/174.1; 277/93 R

[58] Field of Search ..... 415/104, 105, 107, 110, 415/112, 118, 170.1, 174.1, 174.2; 384/481; 277/93 R, 93 SD; 310/90.5

[56] References Cited

U.S. PATENT DOCUMENTS

| | | | |
|---|---|---|---|
| 2,746,671 | 5/1956 | Newcomb | 230/120 |
| 2,822,694 | 2/1958 | McKenney | 310/90.5 |
| 2,966,296 | 12/1960 | Morley et al. | 230/116 |
| 3,512,852 | 5/1970 | North | 310/90.5 |
| 3,550,989 | 12/1970 | Hall | 377/93 R |
| 3,731,984 | 5/1973 | Habermann | 310/90.5 |
| 3,746,461 | 7/1973 | Yokota et al. | 415/104 |
| 3,747,998 | 7/1973 | Klein et al. | 310/90.5 |
| 3,758,226 | 9/1973 | Gyurech | 415/104 |
| 4,413,946 | 11/1983 | Marshall et al. | 415/28 |
| 4,417,734 | 11/1983 | Sundberg | 277/93 RD |
| 4,472,107 | 9/1984 | Chang et al. | 415/104 |
| 4,523,896 | 6/1985 | Lhenry et al. | 310/90.5 |
| 4,527,802 | 7/1985 | Wilcock et al. | 310/90.5 |
| 4,557,664 | 12/1985 | Tuttle et al. | 415/105 |
| 4,578,018 | 3/1986 | Pope | 415/14 |
| 4,697,981 | 10/1987 | Brown et al. | 415/104 |
| 4,768,790 | 9/1988 | Netzel et al. | 277/93 SD |
| 4,792,146 | 12/1988 | Lebeck et al. | 277/93 SD |

FOREIGN PATENT DOCUMENTS

| | | |
|---|---|---|
| 192545 | 9/1919 | Canada . |
| 192628 | 9/1919 | Canada . |
| 1063364 | 10/1979 | Canada . |
| 1082150 | 7/1980 | Canada . |
| 2182400 | 5/1987 | United Kingdom . |
| 2185542 | 7/1987 | United Kingdom . |

*Primary Examiner*—John T. Kwon
*Assistant Examiner*—Hoang Nguyen
*Attorney, Agent, or Firm*—Stevens, Davis, Miller & Mosher

[57] ABSTRACT

A gas compressor, particularly of the kind for boosting pressure in gas transmission lines, has an impeller mounted on a shaft located between two bearings with the gas space surrounding the impeller being separated from the bearings by dry gas seals, including a least primary dry gas seals. The primary dry gas seal adjacent the discharge end of the compressor is of larger diameter than the corresponding seal at the inlet end of the compressor so that pressurized gas acting on the respective rotary parts of the dry gas seals urges the shaft towards the discharge end of the compressor and thus counteracts dynamic forces on the impeller.

14 Claims, 3 Drawing Sheets

GAS COMPRESSOR HAVING DRY GAS SEALS

FIELD OF THE INVENTION

This invention relates to centrifugal or axial flow compressors, and especially compressors which operate at high pressures, such as compressors used in gas transmission lines for boosting pressure. The invention provides an improved method of balancing the forces on a compressor shaft which avoids the drawbacks, especially loss of compressor efficiency, used with presently known arrangements.

PRIOR ART

In most types of compressors commonly used for boosting pressure in gas transmission lines, one or more centrifugal or axial flow impellers are mounted on a shaft and constitute a rotor which rotates within a gas space in the compressor housing to move gas from a suction inlet to a discharge outlet of the space, the shaft being of the beam type wherein the impeller or impellers are mounted between two bearings. This type of compressor will be referred to as being "of the type described". Such a compressor is usually coupled to a gas turbine which provides the drive.

In such compressors, all of the space in which the impellers operate is pressurized at least to the pressure of the gas to be boosted which is several hundred psi. Leakage of gas into the bearing space is controlled by seals. Oil seals have traditionally been used for this purpose but these have certain disadvantages namely that the oil system requires complex oil cooling, pumping, and cleaning. The risks of oil contamination and fire are high. Recently, dry gas seals have been effectively developed for this purpose. In such seals, the sealing function is provided by a very thin film of gas which leaks between two relatively rotating annular surfaces. The leakage across the faces of such dry gas seals is quite low even when pressure differentials are quite high.

Such dry gas seals usually include a rotor fixed to the shaft and a stator which is non-rotatable but slidable relative to the compressor housing, the seal gap being provided between adjacent surfaces of the rotor and stator. Adjacent non-rotating sliding parts of the seal and the rest of the stator structure are sealed by a so-called balancing 0-ring or sealing ring which separates a high pressure zone surrounding most of the outer part of the stator from a low pressure zone within the stator and communicating with the low pressure end of the seal gap. The diameter of this sealing ring thus determines the thrust applied via the stator onto the compressor shaft in the direction opposite that provided by internal pressure acting on the rotor.

Usually, two such dry gas seals are used at each end of the shaft, these being a primary seal which is subjected to most of the pressure differential between the gas and bearing spaces, and a secondary seal which acts as a back-up.

Gas compressors of the type described have large axial thrust imposed on the rotor shaft by reaction forces caused by the impellers accelerating the gases. It is present practice to limit the size of thrust bearing required by means of a so-called balance piston which is mounted on the impeller shaft near to the discharge end of the compressor, with a labyrinth seal being provided between the outer periphery of the piston and the compressor casing. Gas which leaks through the labyrinth seal is normally returned to the suction side of the compressor. Accordingly, the balance piston is exposed on one side to the discharge pressure and on the other side to a pressure similar to the suction pressure, and with suitable sizing of the balance piston this counteracts a large part of the reaction forces on the impeller or impellers. Although this system is adequate for relieving thrust, one drawback is that it reduces the efficiency of the compressor since perhaps 3 to 5% of the gas which has been compressed leaks past the labyrinth seal and has to be recompressed. Balance pistons also add weight to the rotor and increase the shaft length, adversely affecting rotor dynamics and making these more difficult to design.

SUMMARY OF THE INVENTION

In accordance with the invention, in a gas compressor of the type described, and wherein the gas space is separated from the bearings by dry gas seals including at least one primary dry gas seal at each end of the shaft, the dry gas seals each having a narrow radially extending gap between relatively rotating annular faces of a rotor and a stator, and wherein a balancing sealing ring separates a high pressure zone around the stator from a low pressure zone within the stator, the diameter of the balancing sealing ring of that primary dry gas seal associated with the discharge end of the gas space is larger than the corresponding diameter associated with the primary dry gas seal at the suction or inlet end, so that the pressurized gas within the gas space acting on the dry gas seals and associated parts provides a net thrust on the shaft in a direction towards the outlet end of the compressor. This allows the shafts to be balanced without the need for a balance piston and without the loss of compressed gas associated therewith.

The invention is particularly of value in compressors used for high pressure gases, such as those in gas transmission lines, where the pressure drop across the primary dry gas seals is several hundred psi, and usually at least 600 psi. This is much higher than the pressure drop which occurs across a balance piston and allows substantial forces to be applied to the compressor shaft even where the diameter of the primary gas seal at the discharge outlet end is not very much greater than the primary dry gas seal at the suction end. The fact that no balance piston is used contributes to an additional effect, since this means that the primary dry gas seal at the discharge outlet end is subjected to discharge pressure whereas the primary gas seal at the other end is subjected only to suction or inlet pressure.

The invention is particularly valuable where it is desired to use all magnetic bearings for the shaft, since the load applied to a magnetic thrust bearing must be kept within certain limits. A modification of the invention uses signals from a magnetic thrust bearing to ensure that the thrust is held within such limits even with widely differing conditions within the compressor.

BRIEF DESCRIPTION OF THE DRAWINGS

The invention will be more particularly described with reference to the accompanying drawings, in which.

DETAILED DESCRIPTION

Figure 1:
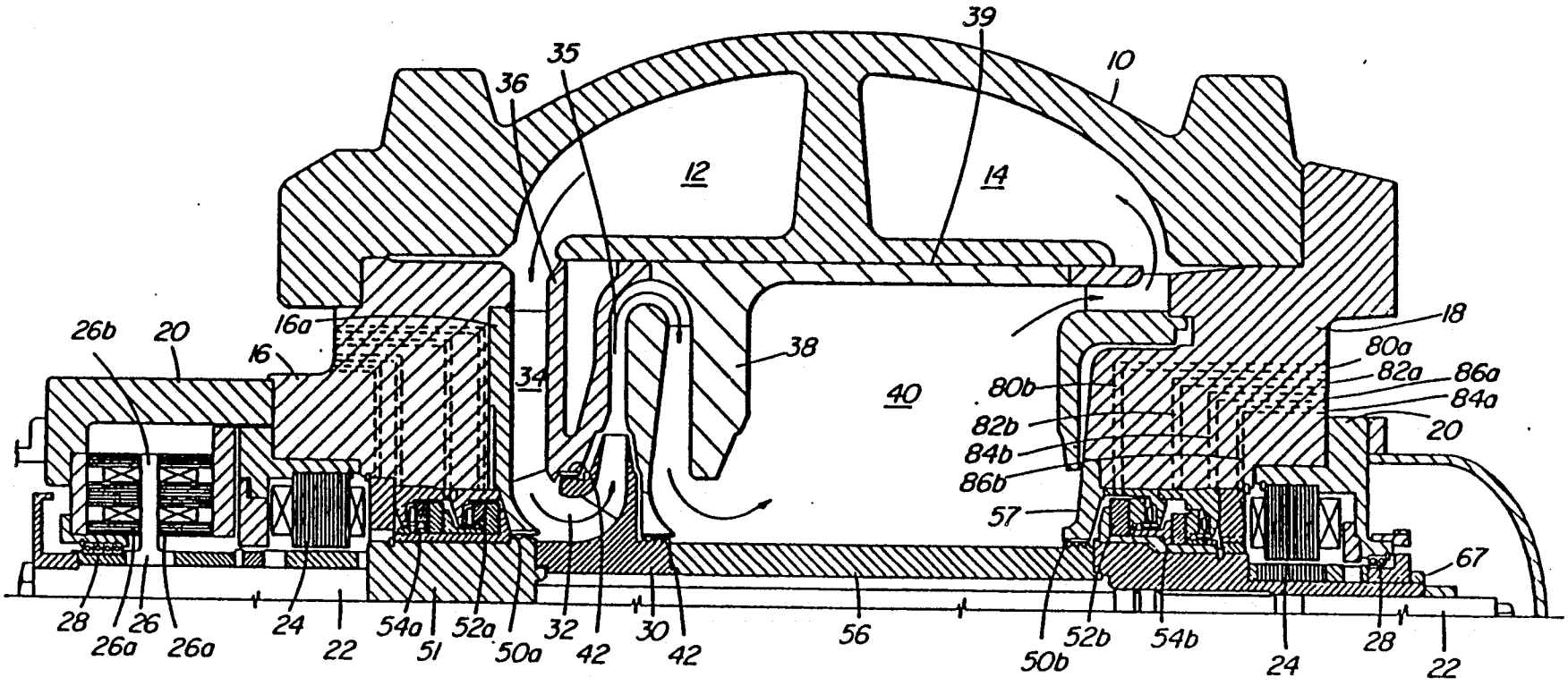
FIG. 1 is a partial longitudinal section through a single stage compressor embodying the invention.

FIG. 1 shows a longitudinal sectional view through the upper part of a gas compressor down to the shaft centre-line CL. The compressor has a casing 10 with suction (inlet) passageway 12 and discharge (outlet) passageway 14; the lower part of the compressor being generally similar except for entrance and exit passageways. The term "suction" in this connection actually means a positive pressure, usually of several hundred psi. The ends of the casing are closed by inlet and outlet covers 16 and 18 respectively, and these end covers support housings 20 for bearings which support the shaft 22. These bearings include magnetic radial bearings 24, a magnetic thrust bearing 26, and auxiliary ball bearings 28 which support the shaft in case the magnetic bearings become inoperative.

The shaft 22 carries a centrifugal impeller 30 having vanes which define passageways 32 connecting a suction passageway 34 and a discharge passageway 35. Passageway 34 is defined by a part **16*a* mounted within a recess in end cover 16, and a so-called inlet diaphragm 36; passageway 35 is defined by the diaphragms 36 and 38 of an exit diaphragm 39 which provides further passageways and a cavity 40 leading to the discharge 14. Labyrinth seals 42 are provided between rotating and non-rotating parts at each end of the impeller, ie. between impeller and inlet diaphragm 36 and between the impeller and the diaphragm 38**.

At each end of the gas space which includes passageway 34, 35 and cavity 40, between this space and the bearings 24, leakage of gas from the space is controlled by primary and secondary dry gas seals indicated respectively at **52*a* and 54*a* for the suction end of the compressor. In addition, a labyrinth seal 50*a* is provided between a stub shaft portion 51 of the rotor shaft and the member 16*a*, while at the discharge end a labyrinth seal 50*b* is provided between the end of an impeller spacer member 56 and an annular member 57 which is set within a recess in end cover 18**, these latter labyrinth seals being a barrier between process gas and clean gas as will be described below.

The four dry gas seals are all generally similar in design, the only difference being that, for reasons to be explained in detail, the primary dry gas seal at the discharge end of the gas space is slightly larger in diameter than the other three dry gas seals. Details of the dry gas seals will be described with reference to FIG. 2 which shows those at the discharge end.

Figure 2:
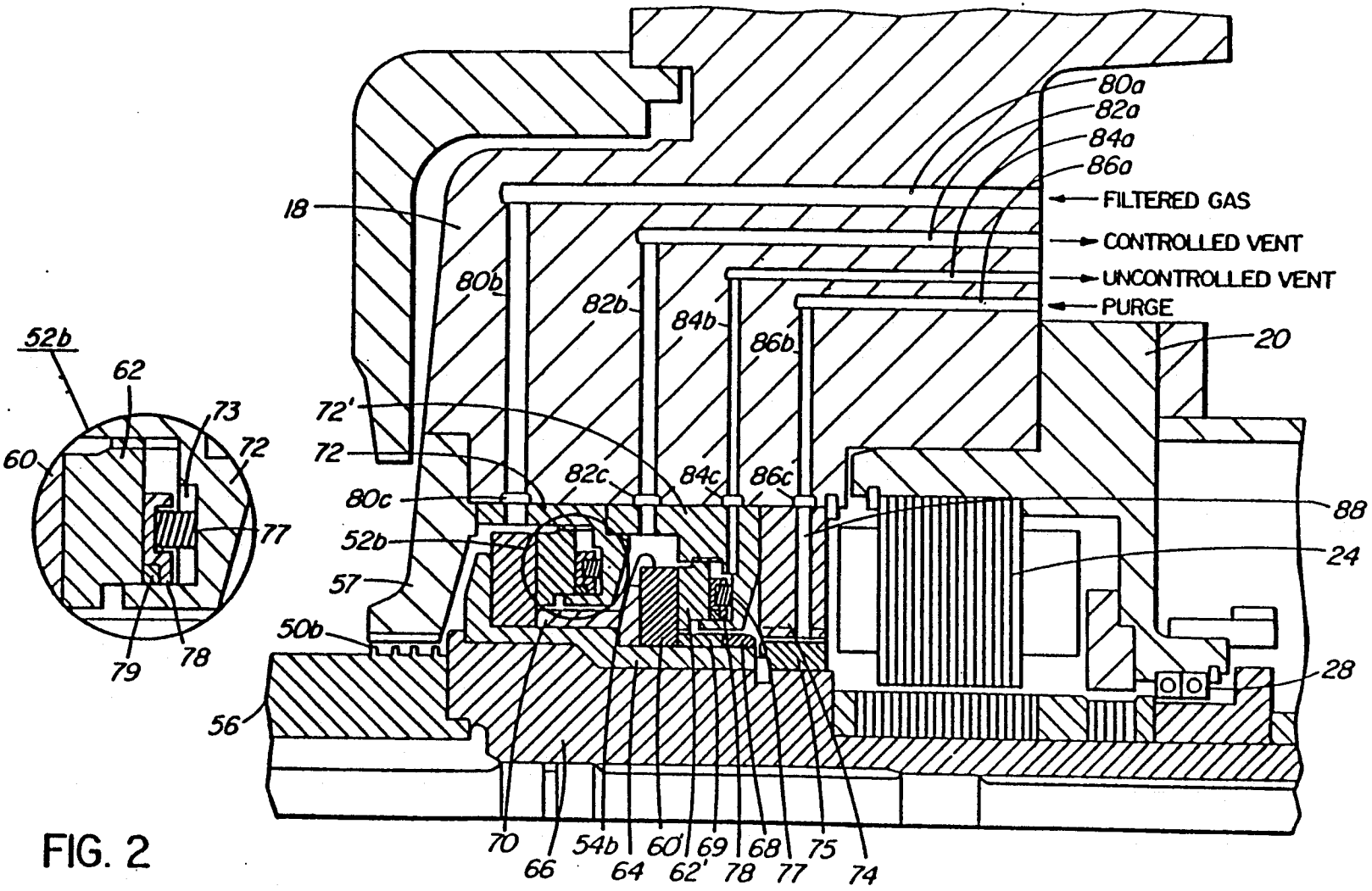
FIG. 2 is an enlarged view of the shaft sealing arrangement at the discharge or outlet end of the compressor.

Each dry gas seal has a very narrow radially extending gap formed between generally flat, relatively rotatable annular surfaces provided by a rotary element or rotor 60 and 60', usually in the form of a tungsten carbide ring, and a stationary element or stator 62 and 62', usually in the form of a carbon or silicon carbide ring. The rotors are held by a sleeve member 64 keyed to a stub shaft part 66 and held onto the stub shaft by locknut 75 (FIG. 2). The rotors are secured in place on the sleeve by a threaded nut 68 acting on a first spacer 69 which acts against rotor 60' in turn pushing spacer 70 against rotor 60. The stators 62 and 62' are held by respective retainers 72 and 72' which are in turn held within a bore in cover 18 between part 57 and a retainer 74. This retainer 74 defines a narrow clearance around a threaded nut 75 mounted on stub shaft 66. The retainers 72, 72' have annular recesses 73 facing the rotors, and these recesses hold the stators 62 and 62' in a manner providing for small axial movement without rotation. Light springs 77 act between the bottoms of these recesses and small recesses within pressure rings 78, thus urging the stators 62 against the rotors 60. So called "balancing" O-rings 79 seal the pressure rings 78 against the inner periphery of retainers 72 and 72' and provide a barrier to the gas on the upstream side of the seal and which is at relatively high pressure in the case of the primary seal. In normal operation a very small gap exists between the adjacent surfaces of the rotors and stators, this gap adjusting itself so that there is a relatively small leakage of gas through this gap and no contact between the rotors and stators. The gap between rotor and stator is so small that these generally move as a unit if the shaft moves axially under the influence of gas forces. These general features of dry gas seals, and particular configurations of co-acting faces which can be used instead of merely flat faces, are known in the art. The pressures within the seal gap may be quite high, but since the pressure acts equally on both rotor and stator, which tend to move axially as a unit, this does not affect the pressure balance of the rotor.

As will be further explained, the primary seal between parts 60 and 62 accounts for most of the pressure drop between the discharge end of the gas space and the bearing space, the latter being usually close to atmospheric pressure; the secondary seal, constituted by parts 60' and 62', provides a back-up in case there is a failure of the primary seal. However, the use of two dry gas seals also allows gas to be removed from between the two seals, for purposes described below.

As will be seen in FIG. 2, the primary and secondary dry gas seals at the discharge end are closely similar in terms of the radial width of the rotors and stator rings, and of the gap therebetween, but the actual inner and outer radii of the seal components are different by virtue of the stepped construction shown. Specifically, the sleeve member 64 and the outer retainer part 72' are both provided with a step formation so that the inner and outer diameters of both the rotor and stator of the primary seal are larger than the corresponding dimensions of the secondary seal parts, and the diameter of the balancing seal rings 79 for the primary seal is also larger than that of the secondary seal. This difference is typically between about 5% and 20% of the inner diameter of the primary stator, which is also the inner diameter of the primary gap; in each case the dimensions will need to be calculated to give a correct pressure balance. By contrast, at the suction end of the gap space, identical dry gas seals are used, the parts of which have the same diameter as the secondary seal for the discharge end. As stated, the primary pressure drop from compressor pressure to the space surrounding the bearing occurs at the primary dry gas seal. Although the dry gas seals have a fairly small diameter compared for example to the diameters of the balance pistons conventionally used, the high pressure drops which exist allow these dry gas seals to exert substantial forces on the rotor which counteract the reaction forces on the impeller which urge the rotor towards the suction end of the compressor.

In the dry gas seal arrangement as shown, the rotor 60 and associated parts adjacent the gas space, and the parts of stator 62 outside the diameter of ring 79, experience a pressure similar to that at the discharge end of the compressor, while parts of the shaft downstream of the primary seal gap and inside the diameter of ring 79 experience a much lower pressure, giving a net force at each end directed outwardly from the gas space. Due to the differences in diameter between the sealing rings 79 of the primary seals at the opposite shaft ends, a net force towards the discharge end is produced which, by reason of the large pressure drops, is sufficient to counteract the force applied to the shaft by the impeller. This counteracting force is much more than would be produced by a balance piston of similar diameter since balance pistons operate on much smaller pressure drops.

Accordingly, it will be seen that by the present invention the previously used balance piston has been entirely eliminated, reducing the complexity of the design and obviating the need for recompressing gas which has leaked past the balance piston, markedly improving compressor efficiency. This has been achieved without any additional parts being used, other than what is required for primary and secondary dry gas seals at each end of the shaft.

Generally similar results could be achieved by making both of the discharge end gas seals of the same diameter as the primary gas seal shown in FIG. 2, with the suction end gas seals having the lesser diameter as described.

In the drawings, rotors 60 and 60' are shown firmly held by associated shaft parts so that negligible gas will leak between the rotors and shaft parts. In some designs of dry gas seal, a sealing ring is used between the rotors and shaft parts; in this case, the diameter of such ring will be the same as that of the associated balancing ring.

The actual thrust balance which is achieved in accordance with the invention will depend on the pressure of gas which is maintained between the primary and secondary seals of the discharge end. As indicated, such pressure is normally fairly close to atmospheric, so that the main pressure drop is across the primary seal. However, various means may be used to control this intermediate pressure, and there will now be described firstly the conventional control means which has been used in compressors using dry gas seals, and secondly a modification of this system which can further improve the balancing of the thrust force achieved in accordance with the present invention.

In a system based on what is now conventional, the end cover 18 is provided with a series of longitudinal ducts 80*a*, 82*a*, 84*a* and 86*a* which communicate respectively with radial bores 80*b*, 82*b*, 84*b* and 86*b*. These bores are all shown in the same plane but it will be understood that they would normally be separated into different radial planes.

Duct 80*a* communicates with bore 80*b* which leads to a circumferential groove 80*c* within the bore of end cover 18 which in turn communicates with apertures through retainer member 72 just upstream of the primary gas seal gap. These means allow filtered gas derived from the process gas being compressed to be pumped into the space between the primary seal gap and the labyrinth seal 50*b*; this provides a positive flow of clean gas which prevents any contaminated gas from entering the dry seal gap.

Duct 82*a* communicates with radial bore 82*b* leading to groove 82*c* which communicates with holes through retainer 72' leading to the space between the primary and secondary gas seals. These bores provide a so-called "controlled vent" the pressure of which is monitored. If the pressure between the gas seals is found to exceed certain limits, indicating either closing the primary seal gap or a too wide opening, the compressor is shut down.

Duct 84*a* leads to radial bore 84*b* communicating with groove 84*c* which in turn communicates with a radial bore passing through retainer 72' and communicating with a space downsteam of the secondary gas seal. These passageways provide a so-called uncontrolled vent which receives the gas which has leaked past the secondary seal.

Duct 86*a* connects with radial bore 86*b* terminating in groove 86*c* which in turn communicates with a passageway 88 in the labyrinth seal retainer 74, leading to the outer side of this ring member and into the space occupied by the magnetic radial bearing. These passageways are used to insert a safe purge gas, ie. one which can be allowed to lead into the compressor building. The pressure of the purge gas is sufficient that some of this gas leaks between parts 74 and 75 and joins the process gas leaking through the uncontrolled vent (passage 84*c*, *b*, *a*). Both the controlled and uncontrolled vents are discharged to atmosphere so that there is no risk of the process gas escaping from the compressor otherwise than through discharge 14.

In this generally conventional system, the pressure of the controlled vent is monitored but not otherwise controlled. In a modification of this invention, this intermediate seal pressure is controlled in order to give further refinement to the balancing to the thrust force on the rotor.

Figure 3:
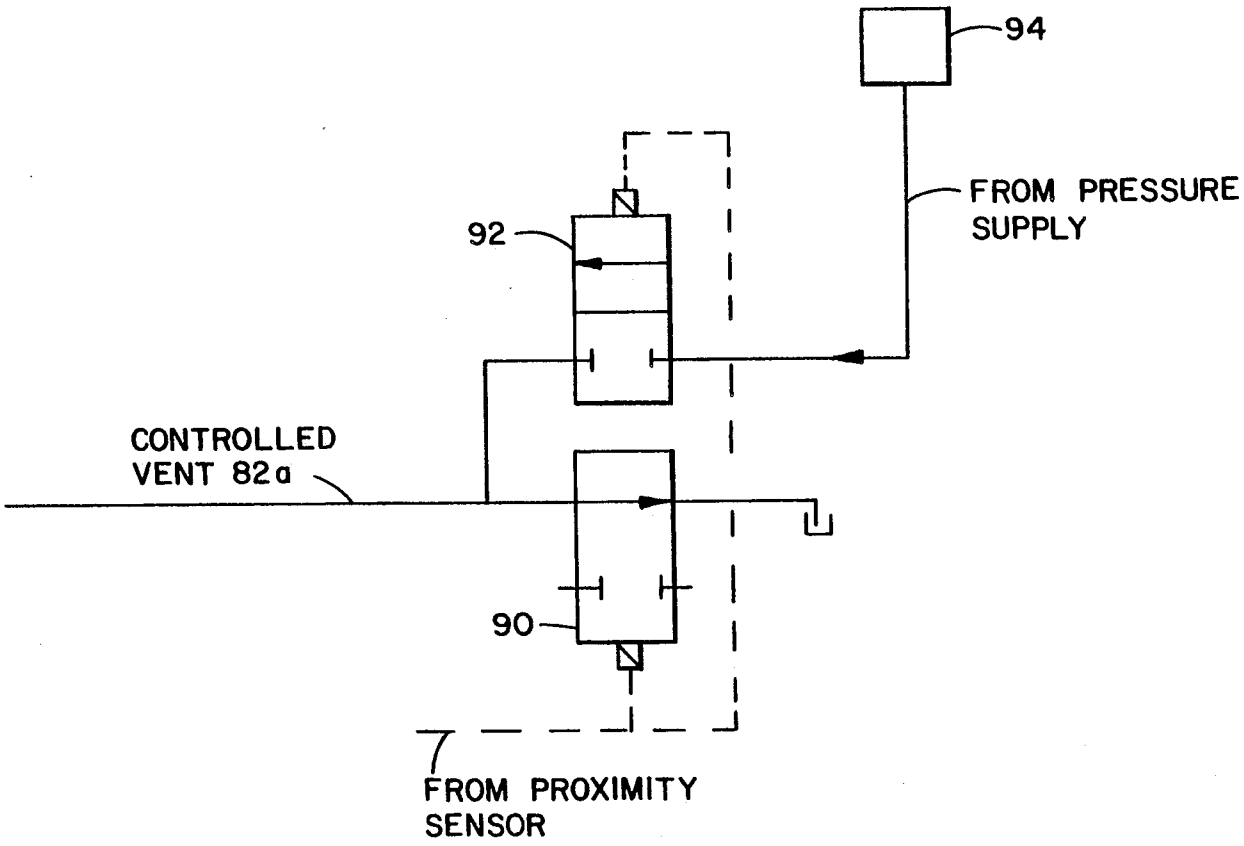
FIG. 3 is a view of solenoids operated by a sensor to control the gas passing through the control vent.

In this modification, signals are taken from the coils which provide the magnetic field for the magnetic thrust bearing 26. The rotor of this bearing has of course a slight clearance space between the two electro-magnets 26*a* and collar 26*b*. Movement of the shaft caused by changing pressure and gasflow conditions in the compressor produce small movements of the rotor. The thrust bearing incorporates an electromagnetic thrust bearing position sensor which at least partially compensates for these changes by increasing or decreasing the currents through the magnets 26*a*. These signals can additionally be used to operate two solenoid valves which control flow of gas to and from a chamber connected to the "controlled vent" passageway 82*a* as shown in FIG. 3. The first of these solenoid valves 90 allows the gas pressure to be vented to atmosphere. The second valve 92 connects the passageway 82*a* to a supply 94 of the process gas at a pressure intermediate atmospheric pressure and the suction pressure of the compressor. In natural gas this supply of gas can conveniently be the same as the fuel gas pipelines such as supply the gas turbine which drives the compressor, this normally being at 250 psig. Operation of these two valves 90, 92 allows the pressure in the space intermediate the primary and secondary gas seals to be varied from close to atmospheric to up to 250 psig, depending on the signals received from the magnetic thrust bearing. By this means, overload conditions on the magnetic thrust bearing can be avoided for a wide variety of compressor conditions.

A similar system may be used with more conventional bearings, such as by hydrodynamic bearings, by the use of a non-contact axial position sensor.

What is claimed is:

1. A rotary fluid machine having a housing, a fluid duct extending through the housing between a suction inlet and a discharge outlet, a rotor assembly rotatable in said duct to be impinged by fluid flowing through the duct from the inlet to the outlet and including a shaft rotatably supported on axially spaced bearings and at least one impeller secured to said shaft between said bearings, a pair of seal assemblies disposed at opposite ends of said duct to seal said shaft within said housing and to inhibit efflux of fluid from the duct, at least one of said seal assemblies comprising a pair of axially spaced seals each disposed between said housing and said shaft to define end walls of a chamber formed therebetween with end wall of said chamber being subjected to fluid pressure in said duct and the other end of said chamber being subjected to a second pressure lower than the duct pressure, said seals being of different effective diameters to provide an area differential therebetween whereby a pressure in said chamber in excess of lower than the duct pressure second pressure will generate an additional axial force on said shaft.

2. The rotary fluid machine according to claim 1, capable of operating at a suction gas inlet pressure of at least 100 psi.

3. The rotary fluid machine according to claim 2, capable of operating at a suction gas inlet pressure of at least 600 psi.

4. The rotary fluid machine according to claim 1 including means to control the pressure of fluid in said chamber.

5. The rotary fluid machine according to claim 1 wherein each of said seals of said one seal assembly are dry gas seals, each having a narrow radially extending gap between relatively rotating annular faces of a rotor and a stator to maintain a pressure differential across said gap, each of said seals also having a balancing sealing ring which contacts the stator to eliminate gas flow past the stator, the diameters of the balancing sealing rings of said seals being different.

6. The rotary fluid machine according to claim 4 wherein one of said seals provides a controlled leakage to said chamber to supply pressurized fluid thereto.

7. The rotary fluid machine according to claim 6 wherein said one of said seals is a dry gas seal.

8. The rotary fluid machine according to claim 6 wherein said one of said seals is disposed between said duct and said chamber.

9. The rotary fluid machine according to claim 8 wherein the other of said seal assemblies includes a dry gas seal and the balancing seal diameter of the dry gas seal adjacent the discharge outlet is from 1% to 30% larger than the balancing seal diameter of the dry gas seal adjacent the suction inlet end of the duct.

10. The rotary fluid machine according to claim 8 wherein each of said seal assemblies include primary and secondary dry gas seals with a chamber therebetween and wherein the primary dry gas seal adjacent the discharge outlet has a balancing seal diameter which is larger than the corresponding balancing seal diameter of the primary gas seal adjacent the suction inlet.

11. The rotary fluid machine according to claim 10 wherein means are provided for controlling the pressure of gas in the chamber between the primary and secondary dry gas seals adjacent the discharge outlet, said controlling means being responsive to signals received from an axial position sensor which senses axial movements of the shaft, such movements from a preferred position causing changes in the pressure in said chamber tending to return the shaft to its preferred position.

12. The rotary fluid machine according to claim 11 wherein the shaft is axially located by a magnetic thrust bearing which incorporates an electromagnetic axial position sensor connected to said controlling means.

13. The rotary fluid machine according to claim 12 wherein said controlling means includes two solenoid valves which control flow of gas to and from said chamber, each of said valves being responsive to electrical signals received from said axial position sensor, one of said valves being operative to vent the chamber to atmosphere and the other being operative to connect the chamber to a source of gas at a pressure which is intermediate atmospheric pressure and the pressure at the suction inlet of the compressor.

14. The rotary fluid machine according to claim 11 wherein said controlling means includes two solenoid valves which control flow of gas to and from said chamber, each of said valves being responsive to electrical signals received from said axial position sensor, one of said valve being operative to vent the chamber to atmosphere and the other being operative to connect the chamber to a source of gas at a pressure which is intermediate atmospheric pressure and the pressure at the suction inlet of the compressor.

* * * * *